United States Patent [19]

Mogensen

[11] 4,010,777

[45] Mar. 8, 1977

[54] METHOD FOR THE ACHIEVEMENT OF AN ACETYLENE GAS MIXTURE

[75] Inventor: Sten Mogensen, Djursholm, Sweden

[73] Assignee: AGA Aktiebolag, Lidingo, Sweden

[22] Filed: June 4, 1975

[21] Appl. No.: 583,751

Related U.S. Application Data

[63] Continuation-in-part of Ser. No. 397,141, Sept. 13, 1973, abandoned.

[30] Foreign Application Priority Data

Sept. 19, 1972 Sweden ..... 12050/72

[52] U.S. Cl. ..... 141/4; 141/9; 252/1

[51] Int. Cl.[2] ..... B65B 31/00

[58] Field of Search ..... 53/7; 141/1, 4, 9; 206/.6, .7; 252/1; 260/679 R

[56] References Cited

UNITED STATES PATENTS

| | | | |
|---|---|---|---|
| 2,849,396 | 8/1958 | Nelson | 252/1 X |
| 2,925,385 | 2/1960 | Winnacker | 252/1 |

*Primary Examiner*—Richard E. Aegerter
*Assistant Examiner*—Frederick R. Schmidt
*Attorney, Agent, or Firm*—Lerner, David, Littenberg & Samuel

[57] ABSTRACT

A method for achieving acetylene gas mixtures which can be stored safely in increased quantities in closed containers, with undiminished safety, is provided.

5 Claims, No Drawings

METHOD FOR THE ACHIEVEMENT OF AN ACETYLENE GAS MIXTURE

CROSS REFERENCES TO RELATED APPLICATIONS

This application is a continuation-in-part of Ser. No. 397,141, filed on Sept. 13, 1973, now abandoned.

FIELD OF THE INVENTION

The present invention relates to a method for the achievement of an acetylene gas mixture which is principally intended for autogenous purposes, such as for example, welding, cutting and soldering, and which is intended to be stored in a container, so as to allow, with undiminished safety, an increase of the total gas content in the container.

BACKGROUND OF THE INVENTION

By virtue of its unique versatility acetylene occupies an exceptional position among flammable gases. It is used therefore, as is well known, for all autogenous purposes such as welding, cutting, soldering, flame hardening, flame cleaning, etcetera. This versatility is based upon the extraordinary concentration of energy which occurs in the acetylene molecule. This concentration of energy provides for a very high combustion temperature and combustion velocity, among other things. However, this property also results in certain disadvantages, specifically a degree of instability for such acetylene, which makes it critical that certain safety measures be taken during its handling and transport. The gas must therefore be stored in special containers, in that they contain a porous mass which completely fills up the interior of the containers, and a solid solvent, including ketones such as acetone or dimethyl formamide, which are absorbed in the mass. The combination of a porous mass in such a solvent enables the container to safely store a greater quantity of acetylene than can be safely stored without such solvent. A considerable disadvantage of such a container is, however, that it is relatively expensive and quite heavy per kilogram of useful products carried therein.

To overcome this disadvantage various experiments have been carried out to replace the acetylene by a suitable gas mixture. As an example, methyl acetylene may be mixed with various materials in proportions which would be suitable for autogenous purposes. Furthermore, ether has been added to propane so as to produce a gas mixture of similar properties. In none of these mixtures has it been possible, however, to obtain the desired properties of pure acetylene. These mixtures have thus proven inadequate to be used for autogenous purposes, and in particular are considerably less suitable for welding.

SUMMARY OF THE INVENTION

The present invention relates to a method which, with undiminished safety, achieves a gas mixture with which the properties of acetylene can be utilized in a more effective and economical manner. This method is characterized in that to the acetylene that is filled into the container are added one or more flammable and stable gases, such as, for example, the $C_1$ through $C_5$ alkanes and alkenes, including ethylene, propane, propylene, ethane, butadiene, butane, butene, etc., whereby the tendency of the acetylene towards decomposition is reduced by these added gases, and in addition these added gases also act as a solvent for the acetylene, and they are due to their volatility, discharged at the same rate as the acetylene.

DETAILED DESCRIPTION

By virtue of the method of this invention, the quantity of gas with which a given container can be filled is raised very substantially without the safety being jeopardized. If the quantity of acetylene thus remains unchanged, the total gas content can be raised by about 30% by the use of these added gases. The quantity of acetylene can, however, also be raised by 10–15%, so that the total quantity of flammable gas in the container may be raised by about 20%. Beside undiminished safety, the present gas mixtures present quite good combustion characteristics, and in particular those required for autogenous purposes such as welding.

Examples demonstrating certain of the possibilities offered by the method in accordance with this invention now follow. These experiments were carried out in a conventional 40 liter acetylene container which had applicable accepted safety standards which permit the filling of same up to a maximum of 8.5 Kg of acetylene. In the cylinders employed in Examples I and II acetone and dimethyl formamide were employed as the solvents. However, in accordance with this invention various solvents may be employed, including ketones, such as in addition to acetone and dimethyl formamide, N-ethyl-2-pyrrolidone and $\alpha$-butyrolacetone. In these cylinders the added gas employed was a mixture of ethylene, propylene and butadiene having a composition as shown in Table I. These gases also have practical significance, since it is just these types of gases which frequently occur as by-products in certain processes, e.g., in the petrochemical manufacture of acetylene. The gases thus obtained occur in approximately the proportions which were used in the gas mixtures in the experiments. The following Table includes a summary of the results obtained in these experiments, as well as the compositions of mixtures of the added gases used in accordance therewith.

TABLE I

QUANTITIES OF ACETYLENE GAS MIXTURES WHICH CAN BE SAFELY STORED IN NORMAL 40 LITER ACETYLENE CYLINDERS (all quantities in kilograms)

| | I | | II | | III | |
|---|---|---|---|---|---|---|
| | A | B | A | B | A | B |
| Acetylene | 8.9 | 9.2 | 8.9 | 9.2 | 8.5 | 8.5 |
| Ethylene | 0.57 | 0.29 | 0.57 | 0.29 | | |
| Added Propylene | 0.42 | 0.21 | 0.42 | 0.21 | none | none |
| gases Butadiene | 0.07 | 0.04 | 0.07 | 0.04 | | |
| | 9.96 | 9.74 | 9.96 | 9.74 | 8.5 | 8.5 |
| Acetone | 11.7 | 11.7 | | | 11.7 | 11.7 |
| Solvent | | | | | | |
| Dimethyl | | | | | | |

TABLE I-continued

QUANTITIES OF ACETYLENE GAS MIXTURES WHICH CAN BE SAFELY STORED IN NORMAL 40 LITER ACETYLENE CYLINDERS (all quantities in kilograms)

| | I | | II | | III | |
|---|---|---|---|---|---|---|
| | A | B | A | B | A | B |
| Formamide | | | 16.4 | 16.4 | 16.4 | 16.4 |

As the Table shows, it was possible in Examples I and II (case A) to increase the quantity of acetylene as well as the total quantity of flammable gas. In addition, in Examples I and II (case B) the quantity of each component in the added gas was reduced to one half. As a result it was possible to raise the quantity of acetylene in the container still further.

It has already been mentioned that acetylene gas has a special character. It burns very rapidly with a higher temperature than other gases. When other flammable and stable gases are blended their combustion temperatures are increased, so that these gases also burn rapidly. These gas mixtures also have properties which largely correspond to those of acetylene, so that it is well suited for autogenous purposes such as e.g., welding.

By means of the specified method it is now possible to raise with undiminished safety, the quantity of acetylene, as well as that of the total gas content, which can be stored in an acetylene container. The added gases are not limited to those mentioned in the foregoing but other types of flammable and stable gases are also quite conceivable within the scope of this invention.

What is claimed is:

1. A method for safely storing increased amounts of acetylene in a gaseous state in closed containers, while reducing the tendency of said acetylene to decompose, which comprises adding a liquid solvent for said acetylene to said container, adding said acetylene to said containers, and adding a sufficient amount of flammable, stable gas selected from the group consisting of the $C_1$ to $C_5$ alkanes, alkenes, and mixtures thereof to said container to act as a solvent for said acetylene, whereby the total amount of said acetylene which can be safely stored in said acetylene-filled closed container is increased by about 10 to 15% by the addition of said flammable, stable gas.

2. The method of claim 1 wherein said solvent comprises a ketone.

3. The method of claim 2 wherein said ketone is selected from the group consisting of acetone, dimethyl formamide, N-methyl-2-pyrrollidone, γ-butyrolactone, and mixtures thereof.

4. The method of claim 1 wherein said flammable stable gas is selected from the group consisting of ethane, ethylene, butane, butene, butadiene, propane, propylene, and mixtures thereof.

5. The method of claim 1 wherein the total amount of gas which can be safely stored in said acetylene-filled closed container is increased by about 30% by the addition of said flammable, stable gas.

* * * * *